US006685509B1

(12) United States Patent
Yeh

(10) Patent No.: US 6,685,509 B1
(45) Date of Patent: Feb. 3, 2004

(54) SHIELDED ELECTRONIC CARD CONNECTOR

(75) Inventor: Joel J. Yeh, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/247,459

(22) Filed: Sep. 18, 2002

(51) Int. Cl.[7] ..... H01R 13/648

(52) U.S. Cl. ..... 439/607; 439/95; 439/108; 439/76.1; 439/181

(58) Field of Search ..... 439/607, 108, 439/95, 76.1, 638, 181, 609, 629, 635, 101

(56) References Cited

U.S. PATENT DOCUMENTS 5,288,247 A 2/1994 Kaufman
5,399,105 A 3/1995 Kaufman et al.
5,470,259 A 11/1995 Kaufman et al.
5,478,253 A * 12/1995 Biechler et al.
5,478,260 A 12/1995 Kaufman et al.
6,319,060 B1 * 11/2001 Wu
6,322,392 B1 * 11/2001 Wang
6,537,084 B2 * 3/2003 Casey et al.

* cited by examiner

*Primary Examiner*—Dean A. Reichard
*Assistant Examiner*—Nguyen T. Ha
(74) *Attorney, Agent, or Firm*—Wei Te Chung

(57) ABSTRACT

An electrical connector (1) includes an insulating housing (2) having a head section (20) and a pair of guiding arms (22) extending rearwardly from opposite ends of the head section, a number of signal and power contacts (3, 4) retained in the head section and a conductive shield (5) enclosing the housing. The conductive shield includes first and second plates (6, 7) mechanically connected with each other and respectively covering top and bottom surfaces (210, 212) of the insulating housing. The signal and power contacts have solder tails (34, 44) extending beyond a rear edge of the first and second plates for electrically connecting to an electronic card. The first and second plates have grounding tails (63, 73) for electrically connecting to the electronic card.

16 Claims, 5 Drawing Sheets

SHIELDED ELECTRONIC CARD CONNECTOR

CROSS-REFERENCE TO RELATED APPLICATIONS

This patent application is related to a U.S. Patent Application filed on Sep. 11, 2002 and entitled "ELECTRONIC CARD CONNECTOR HAVING POWER CONTACTS" which was invented by the same inventor as this patent application and assigned to the same assignee with this application.

BACKGROUND OF THE INVENTION

1. Field of the Invention

The present invention relates to an electronic card connector, and particularly to an electronic card connector having conductive shell covering top and bottom surfaces of an insulating housing thereof.

2. Description of Related Art

Electronic card connectors are widely used in electronic products, such as personal computers, for electrically connecting with electronic cards which function as removable mass storage devices. A conventional electronic card connector generally comprises a pair of parallel guiding arms, a head portion located between the guiding arms, and a plurality of contacts retained in the head portion for electrically connecting with an inserted electronic card and a mother board on which the electronic card connector is seated. However, with the high speed signal transmission of the electronic card connectors, grounding reference and electromagnetic interference may become a serious problem.

U.S. Pat. Nos. 5,288,247, 5,478,260, 5,470,259 and 5,399,105 each disclose a conductive shell to solve the above-mentioned problem.

Conductive shells disclosed in the '247 and '260 patents are identical in structure. Each shell includes a top plate enclosing a top of an electrical connector, contact spring fingers extending from an edge of the top plate to electrically engage a conductive outer surface of a memory card that is mated to the electrical connector. Furthermore, each shell is arranged to be electrically connected to ground circuitry on a mother board.

A conductive shell disclosed in the '259 patent is used with an electrical connector having terminals with surface mountable contact sections for electrically engaging circuitry on a mother board. The shell includes a plate-like body having first and second portions. The first portion is adapted to be disposed on a top face of an insulating housing. The second portion is configured to extend over the surface mountable contact sections when the shell is disposed on the housing. The second portion defines at least one elongated aperture extending therethrough proximate the surface mountable contact sections. The aperture permits sufficient heat generated during the soldering process to reach contact pads on the mother board to melt the solder thereby assuring a reliable electrical engagement between the surface mountable contact sections and the mother board.

A conductive shell disclosed in the '105 patent is used for two vertically stacked electrical connectors. The shell includes a first plate separating the two connectors and a second plate spaced from and parallel to the first plate. Contact spring fingers extend from edges of each of the first and second plates to electrically engage outer conductive surfaces of two memory cards.

Electrical performance of the electronic card connector is improved in a certain extent by the use of such shells disclosed in the above references. However, each shell only includes a top plate enclosing a top of the connector while a bottom of the connector is still exposed out of the shell, whereby the electromagnetic interference of the electrical connector cannot be effectively reduced. Furthermore, when the electronic card connector is required to transmit power, an insulating housing of the connector must be properly configured to arrange power contacts. Thus, a newly designed conductive shield must be provided to enclose the insulating housing for ensuring a good electrical performance of the electronic card connector.

Hence, an electronic card connector having an improved conductive shield is required to overcome the disadvantages of the related art.

SUMMARY OF THE INVENTION

It is an object of the present invention to provide an electronic card connector having conductive shield enclosing both top and bottom surfaces of the connector for ensuring a good electrical performance thereof.

In order to achieve the object set forth, an electrical connector in accordance with the present invention comprises an insulating housing having a head section and a pair of guiding arms extending rearwardly from opposite ends of the head section for guiding the insertion of an electronic card, a plurality of signal and power contacts retained in the head section for being soldered to conductive pads on the electronic card and a conductive shield enclosing the housing. The conductive shield includes first and second plates mechanically connected with each other and respectively covering top and bottom surfaces of the insulating housing. The signal and power contacts have solder tails extending rearwardly beyond a rear edge of the first and second plates for permitting the sufficient heat generated during the soldering process to reach the contact pads on the electronic card to melt the solder, thereby ensuring a reliable electrical connection between the electrical connector and the electronic card. The first and second plates have grounding tails for electrically connecting to the electronic card.

Other objects, advantages and novel features of the invention will become more apparent from the following detailed description when taken in conjunction with the accompanying drawings.

DETAILED DESCRIPTION OF THE INVENTION

Figure 1:
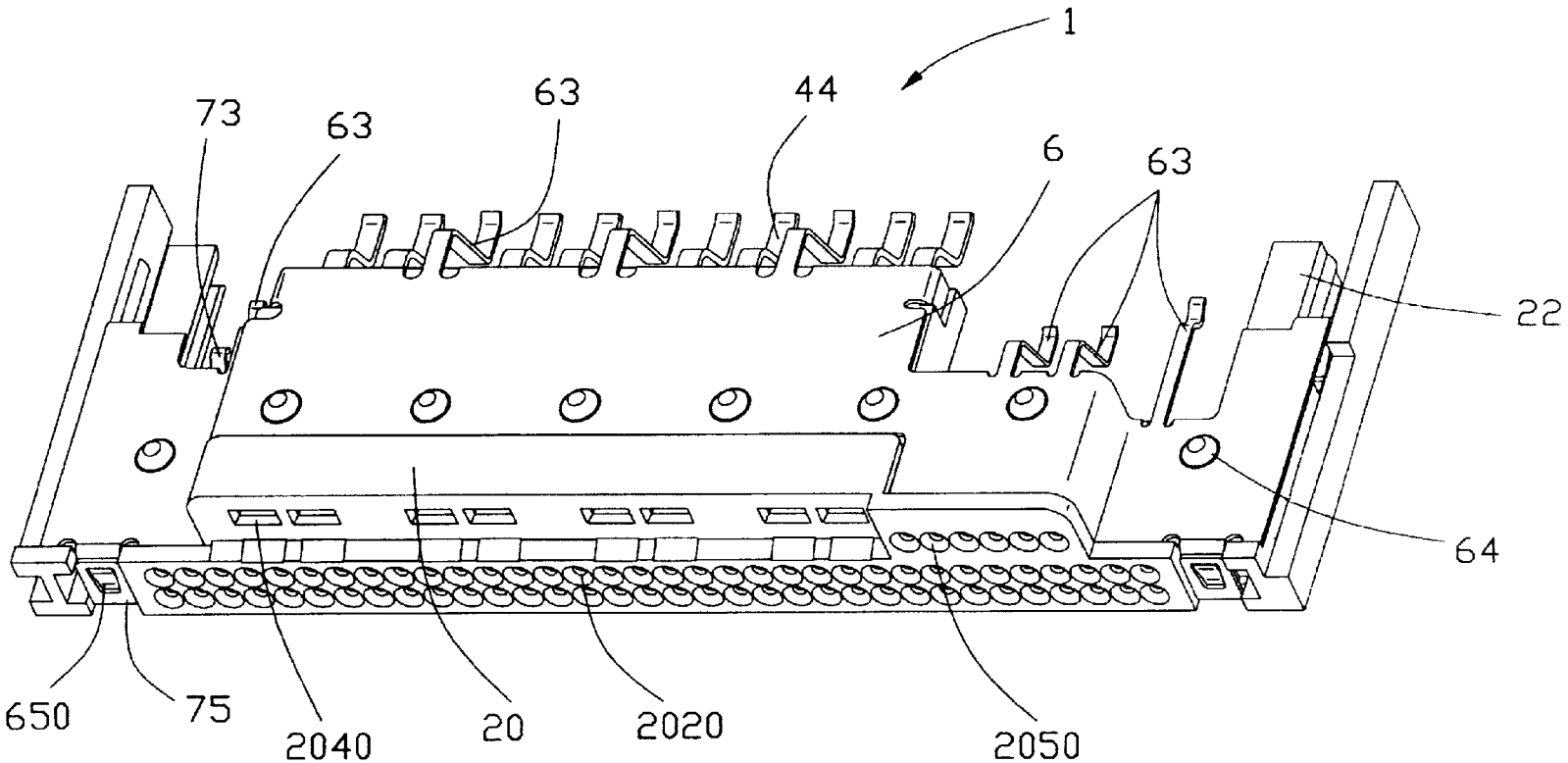
FIG. 1 is a top assembled perspective view of an electronic card connector having conductive shield in accordance with the present invention.
Figure 2:
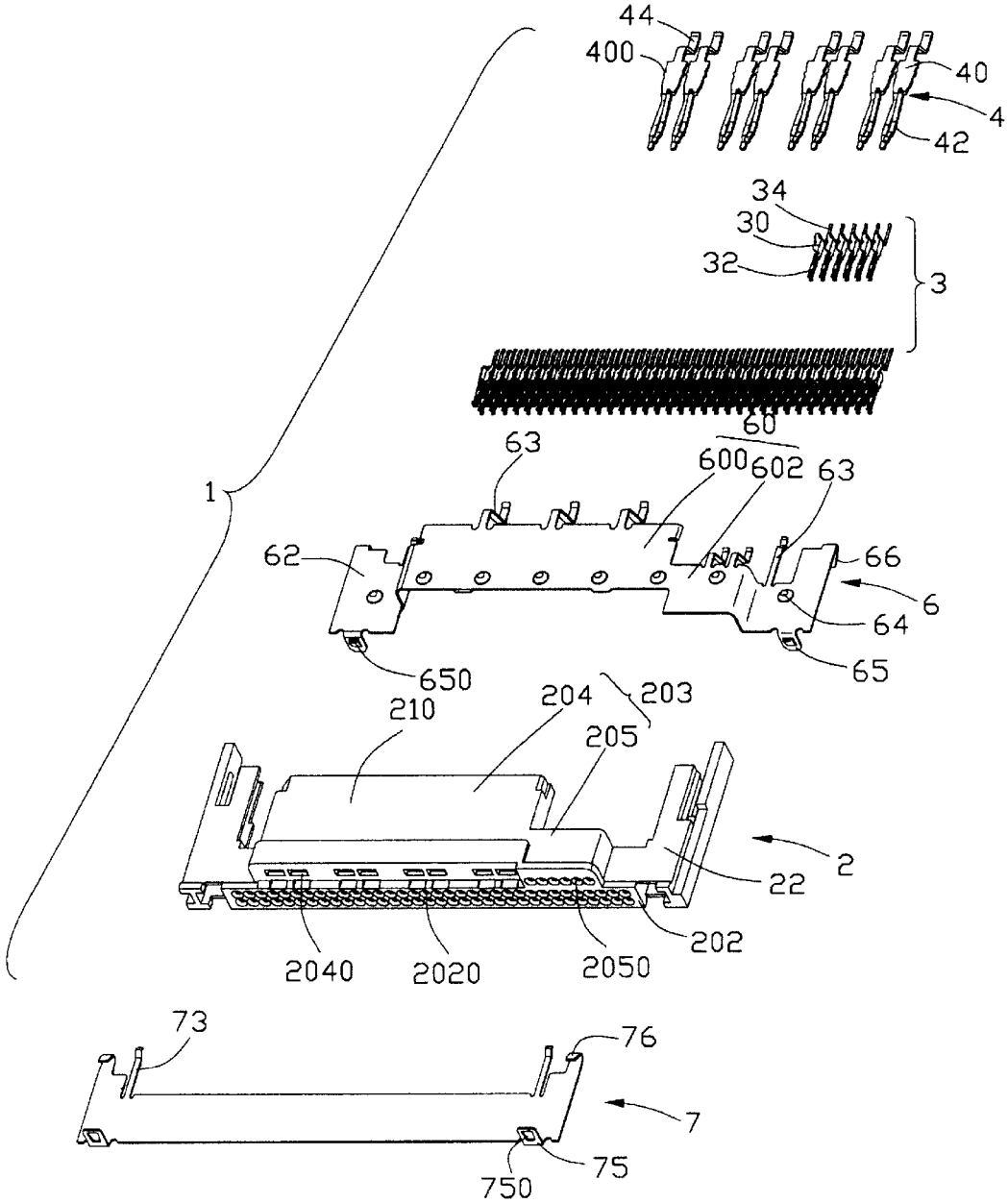
FIG. 2 is a top exploded perspective view of the electronic card connector of FIG. 1.
Figure 5:
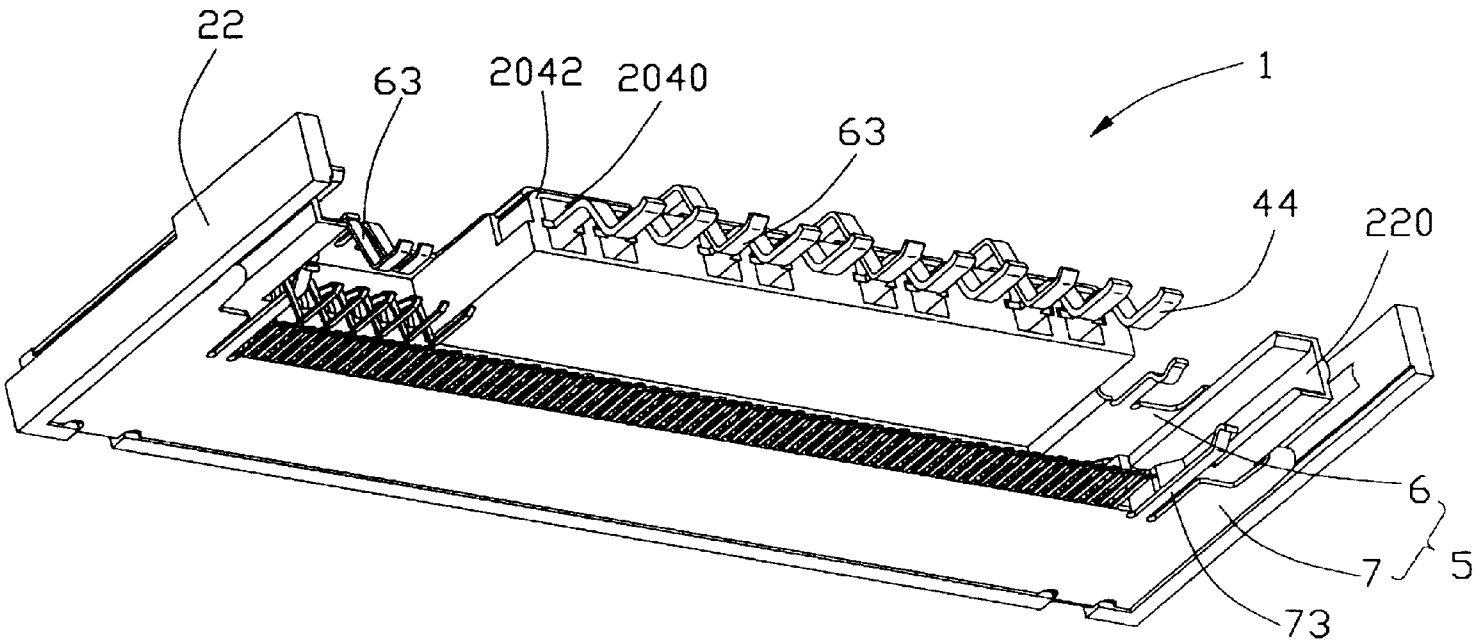

Referring to FIGS. 1, 2 and 5, an electronic card connector 1 in accordance with the present invention comprises an insulating housing 2, a plurality of signal contacts 3 and power contacts 4 retained in the insulating housing 2 respectively for signal and power transmission, and a conductive shield 5 enclosing the insulating housing 2 for grounding purpose and electromagnetic protection.

Figure 3:
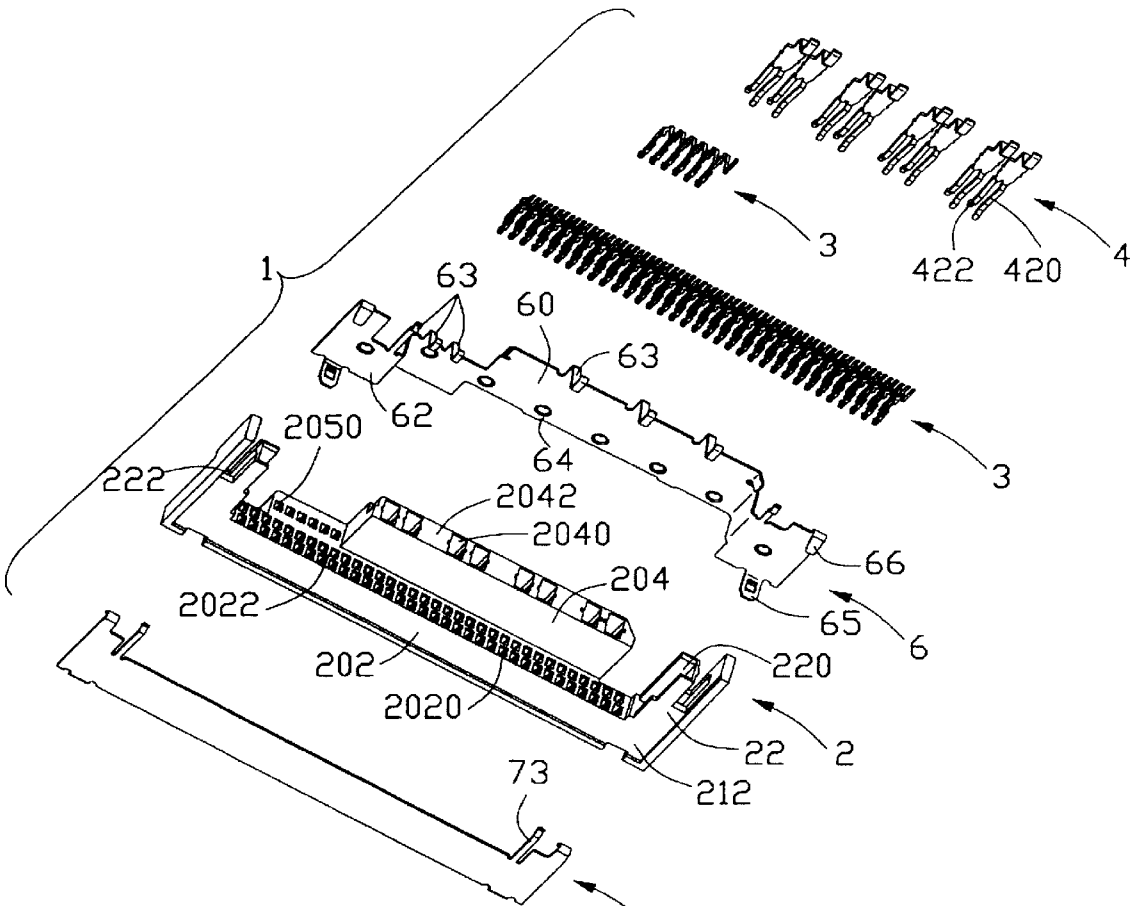
FIG. 3 is a bottom exploded perspective view of the electronic card connector of FIG. 1.

Referring to FIGS. 2 and 3, the insulating housing 2 includes a step-shaped head section 20 and a pair of guiding arms 22 extending rearwardly from opposite ends of the head section 20. The guiding arms 22 define a pair of opposite guiding channels 220 for guiding the insertion of an electronic card (not shown). The head section 20 has an elongated body 202 with two rows of passageways 2020 extending therethrough in a back-to-front direction, and a projection 203 located above the body 202. The projection 203 includes a first portion 204 which has a rear face 2042 extending rearwardly beyond a rear face 2022 of the body 202, and a second portion 205 which has a rear face coplanar with the rear face 2022 of the body 202. The first and second portions 204, 205 of the projection 203 respectively define a row of cavities 2040 and passageways 2050 in the back-to-front direction.

Figure 4:
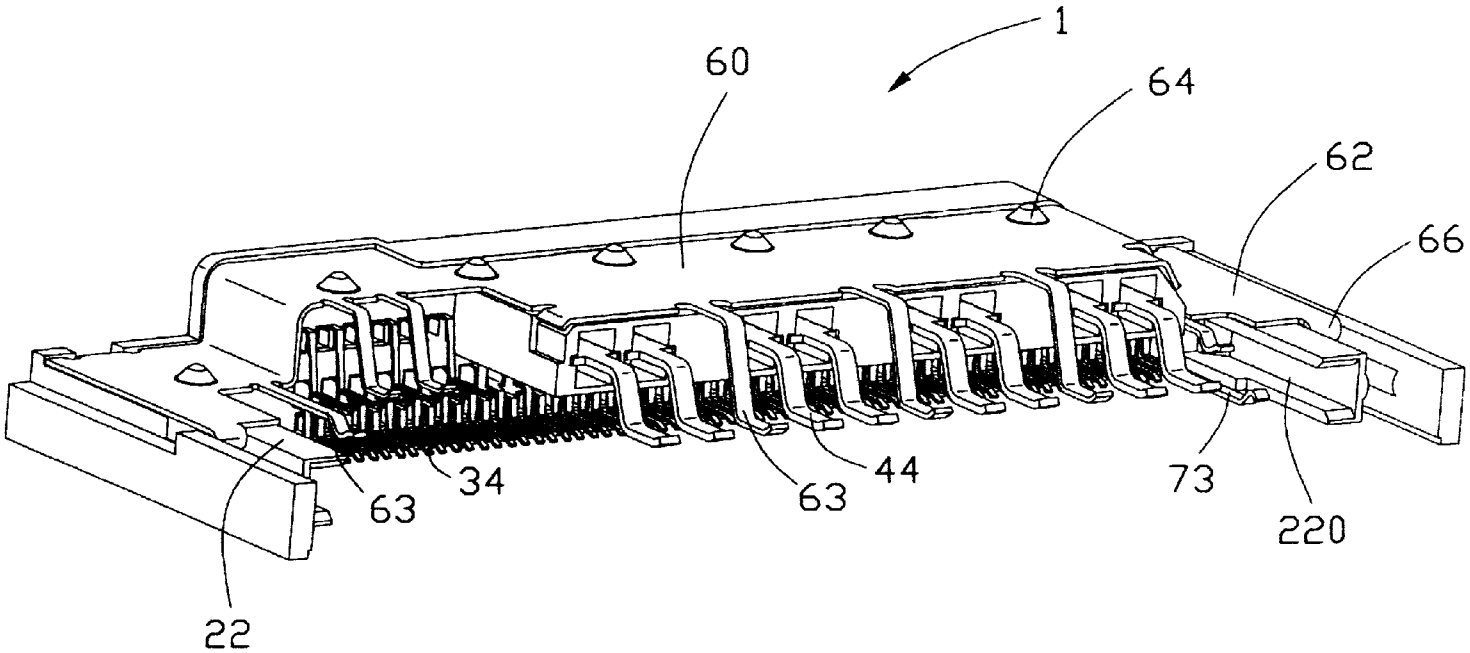
FIGS. 4 and 5 show the electronic card connector similar to FIG. 1 but taken from different perspectives.

The signal contacts 3 and the power contacts 4 are respectively formed from a metal sheet. Referring to FIGS. 4 and 5 in conjunction with FIGS. 2 and 3, the signal and power contacts 3, 4 are respectively inserted into the passageways 2020, 2050 and the cavities 2040 of the head section 20 in the back-to-front direction. Each signal contact 3 includes a retention portion 30 for being fixedly retained in the passageways 2020, 2050, a mating portion 32 extending forwardly from the retention portion 30 for engaging with a complementary connector (not shown), and a tail portion 34 extending rearwardly from the retention portion 30 and beyond the rear face 2022 of the body 202 for soldering to conductive pads on the electronic card.

Each power contact 4 that has a different dimension and structure with each signal contact 3 includes a planar retention portion 40 with barbs 400 formed on opposite side edges for interferential engagement with the first portion 204 of the projection 203 in a corresponding cavity 2040, a mating portion 42 extending forwardly from the retention portion 40 for engaging with the complementary connector, and a tail portion 44 extending rearwardly from the retention portion 40 and beyond the rear face 2042 of the first portion 204 for soldering to the conductive pad on the electronic card. The mating portion 42 of the each power contact 4 has a pair of laterally offset, vertically opposing cantilevered spring arms 420, 422 extending from opposed sides of the retention portion 40.

In the preferred embodiment of the present invention, the conductive shield 5 is a two-piece configuration including top and bottom plates 6, 7 respectively for covering top and bottom surfaces 210, 212 of the housing 2. The top plate 6 includes a main portion 60 abutting against the projection 203, and a pair of side portions 62 extending laterally and downwardly from opposite side edges of the main portion 60 for abutting against the body 202. The main portion 60 includes first and second portions 600, 602 respectively for covering the first and second portions 204, 205 of the projection 203. The top plate 6 has a plurality of grounding fingers 63 extending rearwardly and downwardly from a rear edge of the top plate 6 for electrically soldering to the conductive pad on the electronic card using a surface mount technology. A pair of locking tabs 65 and folding tabs 66 are respectively located at front and rear edges of the side portions 62. Each locking tab 65 of the top plate 6 has a projection 650 formed thereon. The top plate 6 further forms a plurality of dimples 64 for electrically engaging with a conductive shield of the complementary connector, thereby providing a ground path between the electronic card connector 1 and the complementary connector.

The bottom plate 7 has a pair of grounding fingers 73 extending rearwardly from a rear edge thereof for soldering to the electronic card, a pair of locking tabs 75 located at a front, side edge thereof, and a pair of folding tabs 76 located at a rear, side edge thereof. Each locking tab 75 of the bottom plate 7 defines an opening 750 therein.

The top and bottom plates 6, 7 are assembled to the insulating housing 2 respectively from the top and bottom surfaces 210, 212. The projections 650 of the locking tabs 65 of the top plate 6 are received and retained in the openings 750 of the locking tabs 75 of the bottom plate 7 to secure the top and bottom plates 6, 7 together. At the same time, the folding tabs 66 of the top plate 6 and the folding tabs 76 of the bottom plate 7 are both received in slots 222 (FIG. 3) of the guiding arms 22 and resiliently abut against each other. Thus, the top and bottom plates 6, 7 are secured on the insulating housing 2. The locking tabs 65 and the folding tabs 66 of the top plate 6 respectively contact with the locking tabs 75 and the folding tabs 76 of the bottom plate 7 to thereby ensuring an electrical continuity between the top and bottom plates 6, 7.

The tail portions 34 of the signal contacts 3 extend rearwardly beyond a rear edge of the second portion 602 of the top plate 6 and the rear edge of the bottom plate 7, and the tail portions 44 of the power contacts 4 extend rearwardly beyond a rear edge of the first portion 600 of the top plate 6 and the rear edge of the bottom plate 7 to thereby permitting sufficient heat generated during the soldering process to reach the contact pads on the electronic card to melt the solder, whereby a reliable electrical engagement is ensured between the electronic card connector 1 and the electronic card.

It is noted that the conductive shield 5 can be made as a unitary configuration to cover the top and bottom surfaces 210, 212 of the housing 2. A feature of the present invention is that the conductive shield 5 encloses both the top and bottom surfaces 210, 212 of the electronic card connector 1 to thereby ensure a good electrical performance of the electronic card connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for engaging with an a circuit board, comprising:

an insulating housing including a step-shaped head section having a body and a projection located above the body and a pair of guiding arms extending rearwardly from opposite ends of the head section for guiding the insertion of the circuit board;

a plurality of first and second contacts respectively retained in the body and the projection, each first contact having a different structure with each second contact, the first and second contacts having solder tails for electrically connecting to the circuit board; and a conductive shield substantially covering top and bottom surfaces of the insulating housing and having grounding tails for electrically connecting to the circuit board.

2. The electrical connector as claimed in claim 1, wherein the conductive shield includes first and second plates mechanically connected with each other.

3. The electrical connector as claimed in claim 2, wherein the first plate defines a plurality of dimples for electrically connecting with a complementary connector.

4. The electrical connector as claimed in claim 2, wherein the first plate and the second plate respectively define a projection and an opening, the projection being received in the opening for securing the first and second plates together.

5. The electrical connector as claimed in claim 1, wherein the grounding tails of the conductive shield are disposed adjacent to the first and second contacts.

6. The electrical connector as claimed in claim 1, wherein the conductive shield includes first and second plates respectively covering the top and bottom surfaces of the insulating housing, the first plate having a main portion covering the projection and a pair of side portions lower than the main portion for covering the body.

7. The electrical connector as claimed in claim 1, wherein the projection has a rear face extending rearwardly beyond a rear face of the body.

8. An electrical connector for engaging with a circuit board, comprising:

an insulating housing including a step-shaped head section having a body and a projection located above the body, and a pair of guiding arms extending rearwardly from opposite ends of the head section for guiding the insertion of the circuit board;

a plurality of signal and power contacts respectively retained in the body and the projection, the signal and power contacts having solder tails for being electrically soldered to the electronic card by fusible paste; and a conductive shield substantially enclosing top and bottom surfaces of the insulating housing and having at least one grounding tail for electrically connecting to the circuit board, and the solder tails of the signal and power contacts extending rearwardly beyond a rear edge of the conductive shield.

9. The electrical connector as claimed in claim 8, wherein the projection has a rear face extending rearwardly beyond a rear face of the body.

10. The electrical connector as claimed in claim 8, wherein the conductive shield defines a plurality of dimples for electrically connecting with a complementary connector.

11. An electrical connector comprising:

an insulative housing including a head section and a pair of guiding arms extending rearwardly from two opposite ends of the head section;

said housing including an elongated body having a same level with the pair of guiding arms, and a projection elevated above said elongated body;

a plurality of first contacts received in the elongated body with surface mounting tails commonly located in a first horizontal plane;

a plurality of second contacts received in the projection with surface mounting tails located commonly in said first horizontal plane; and a shielding device covering a top face of the projection and a bottom face of the elongated body, said shielding device including a plurality of grounding fingers, of which some have corresponding surface mounting tails coplanar with said first horizontal plane.

12. The connector as claimed in claim 11, wherein some other of said grounding fingers have corresponding surface mounting tails located in a second horizontal plane spatially below said first horizontal plane.

13. The connector as claimed in claim 12, wherein said first plane and said second plane commonly define therebetween a dimension similar to a thickness of a circuit board inserted into opposite guiding channels defined in the pair of guiding arms.

14. The connector as claimed in claim 11, wherein said some of the grounding fingers are interleaved with the surface mounting tails of the second contacts, respectively.

15. An electrical connector for engaging with a circuit board, comprising:

an insulating housing including a head section and a pair of guiding arms extending rearwardly from opposite ends of the head section for guiding the insertion of the circuit board, the housing defining a slot therein;

a plurality of first and second contacts retained in the head section, each first contact having a different structure with each second contact, the first and second contacts having solder tails for electrically connecting to the circuit board; and a conductive shield comprising first and second plates mechanically connected with each other and respectively covering top and bottom surfaces of the insulating housing, the first and second plates each having a folding tab received in the slot for securing the first and second plates on the housing and having grounding tails for electrically connecting to the circuit board.

16. The electrical connector as claimed in claim 15, wherein the folding tab of the first plate resiliently and electrically abuts against the folding tab of the second plate.

* * * * *